US005170002A

United States Patent [19]

Suzuki et al.

[11] Patent Number: 5,170,002

[45] Date of Patent: Dec. 8, 1992

[54] MOTION-CONTROLLED MUSICAL TONE CONTROL APPARATUS

[75] Inventors: Hideo Suzuki; Shunichi Matsushima; Masahiko Obata; Masao Sakama, all of Hamamatsu, Japan

[73] Assignee: Yamaha Corporation, Hamamatsu, Japan

[21] Appl. No.: 873,646

[22] Filed: Apr. 23, 1992

Related U.S. Application Data

[63] Continuation of Ser. No. 600,127, Oct. 19, 1990, abandoned, which is a continuation of Ser. No. 290,244, Dec. 23, 1988, abandoned.

[30] Foreign Application Priority Data

Dec. 24, 1987 [JP] Japan ..... 62-328063
Feb. 3, 1988 [JP] Japan ..... 63-13243[U]

[51] Int. Cl.[5] ..... G10H 1/32; G10H 7/00

[52] U.S. Cl. ..... 84/600; 84/626; 84/644; 84/658; 84/670

[58] Field of Search ..... 84/327, 329, 453, 465, 84/600, 626-633, 644, 658, 662-665, 670, 687-690, 701-711, 718, 737-741, 743, DIG. 7, DIG. 8, DIG. 12; 446/242, 397, 408; 273/DIG. 17, DIG. 19; 73/514, 517 R, 517 AV, 517 B, 517 A

[56] References Cited

U.S. PATENT DOCUMENTS 3,935,669 2/1976 Potrzuski et al. .
4,341,140 7/1982 Ishida ..... 84/DIG. 12
4,627,324 12/1986 Zwosta ..... 84/687 X
4,635,516 1/1987 Giannini ..... 84/DIG. 8 X
4,662,260 5/1987 Rumsey .
4,753,146 6/1988 Seiler ..... 84/1.24 X
4,776,253 10/1988 Downes ..... 446/242 X
4,776,323 10/1988 Spector ..... 84/465 X
4,909,117 3/1990 Reiling et al. ..... 84/738

FOREIGN PATENT DOCUMENTS 0264782 4/1988 European Pat. Off. .
2071389 9/1981 United Kingdom .
2153579 8/1985 United Kingdom .

*Primary Examiner*—Stanley J. Witkowski
*Attorney, Agent, or Firm*—Graham & James

[57] ABSTRACT

Musical instruments usually require a high level of skill on the part of the operator. In the case of electronic instruments, playing an instrument often involves the depressing of keys on a keyboard. In the present invention, an apparatus for the generation of musical sounds is described which is instead based on monitoring motions of the body, especially the natural motion of swinging the arms and legs. The monitoring of body motion depends on the use of an acceleration sensor in a hand-held element, or on the use of an acceleration sensor contained in a detachable housing which is held by a "Velcro" (Trademark) type fastener to a part of the body. The signal from the acceleration sensor is transmitted via a cable or a wireless transmitter to a musical tone signal generating circuit which is contained, along with batteries, in a belt-shaped casing which may be worn by the user. The musical tone generating circuit receives signals from the acceleration sensor, and using the musical tone color information stored in its memory, produces the appropriate output signal. Therefore, musical tones can be generated simply by moving a monitored part of the body, without the actions usually required to play an electronic musical instrument.

14 Claims, 13 Drawing Sheets

MOTION-CONTROLLED MUSICAL TONE CONTROL APPARATUS

This is a continuation of copending application Ser. No. 07/600,127 filed on Oct. 19, 1990, now abandoned which is a continuation of Ser. No. 290,244, filed Dec. 23, 1988, now abandoned.

BACKGROUND OF THE INVENTION

Field of the Invention

The present invention relates to a musical tone control apparatus that can control musical tones by monitoring human motion, especially the swinging of arms and legs.

Prior Art

Generally, on acoustical musical instruments, sounds are generated by plucking a string, striking a key on a keyboard, striking a percussion instrument, or blowing into a wind instrument. Many electronic musical instruments are controlled by striking a key on a keyboard. If musical tones could instead be generated by monitoring a natural human motion, a musical instrument could be used irrespective of the conventional concept of "playing", producing a new type of entertainment and allowing new playing effects. However, there has been no musical instrument such that musical tones could be generated irrespective of the concept of playing, and therefore the development of a new type of musical tone control apparatus has been desired.

Of the many possible human motions, the action of "swinging" of the arms and legs is one of the most natural. It requires no training, and it is an action in which people exhibit high dexterity. If musical tones could be produced by monitoring, for example, the movement of hands or feet when a person is dancing or exercising, musical tones could be produced irrespective of the action of playing an instrument. Therefore, if the musical tone emitted by a musical apparatus could be controlled by monitoring the action of "swinging", the above-described desired musical instrument, which requires no playing, would be achieved. Furthermore, if the monitored movements for the hands, feet and other body parts were detected and processed separately, a wide variety of complex tone patterns could be achieved.

SUMMARY OF THE INVENTION

It is therefore an object of the present invention to provide a motion-controlled musical tone control apparatus which does not have to be "played" in the conventional sense, but which can instead be controlled by a movement such as the swinging of a body part, as for example, an arm or a leg.

Another object of the present invention is to provide acceleration sensor elements that have an appropriate shape so that the acceleration sensor may be easily held in the hand. In order to provide a sensor element which can be easily held in the hand, one possible embodiment of the present design comprises a ring-shaped body that can be held by a grip, a musical tone selection switch, an acceleration sensor which can detect the changing position or acceleration of the ring-shaped body, said sensor mounted inside the ring-shaped body, and a musical tone control signal generating means that generates a musical tone control signal for controlling the musical tone emitted by a speaker, based on the signal from the acceleration sensor. Many shapes other than the ring-shaped body are possible to contain the acceleration sensors. The ring-shaped body is presented only as a preferred embodiment of the present invention.

A further object of the invention is to provide, in cases in which it is not desirable to hold the acceleration sensor in the hand, an acceleration sensor housing which allows the acceleration sensor to be attached to a part of the body.

When an acceleration or a change of position causes the acceleration detector to trigger, a signal produced by the acceleration sensor is transmitted to the musical tone signal generating circuit of the present invention, which converts the signal from the acceleration sensor into a musical tone signal. This signal is transmitted to a musical tone signal generating circuit of the present invention by a cable or by wireless means. It is a still further object of this invention to provide musical tone signal generating circuits to convert the acceleration sensor signal to a musical tone signal, which can then be used to generate a musical tone.

It is an additional object of this invention to provide a belt-shaped casing to contain the musical tone signal generating circuit and batteries. This arrangement allows the user to move about freely without being restrained by a cable to supply power to the apparatus.

BRIEF DESCRIPTION OF THE DRAWINGS

The drawings are arranged such that the embodiment having the acceleration sensor in the ring-shaped body to be held in the hand is illustrated first in FIGS. 1 through 10; the embodiment in which the acceleration sensor contained in a housing is attached to a part of the body by a detachable means is illustrated in FIGS. 11 through 17.

DETAILED DESCRIPTIONS OF THE PREFERRED EMBODIMENTS

In a first possible embodiment of the present invention, in which it is desirable to hold the acceleration sensor in the hand in order to control the musical tone by swinging the arms, a ring-shaped body is provided to contain one or more acceleration sensors. Said ring-shaped body comprises an exterior toroidal major section, an interior partial toroidal minor section, a grip which has a tone selection switch mounted on it, an acceleration sensor, and a means to transmit the signal from the acceleration sensor to the musical tone signal generating circuit by a cable or by wireless means.

Figure 1:
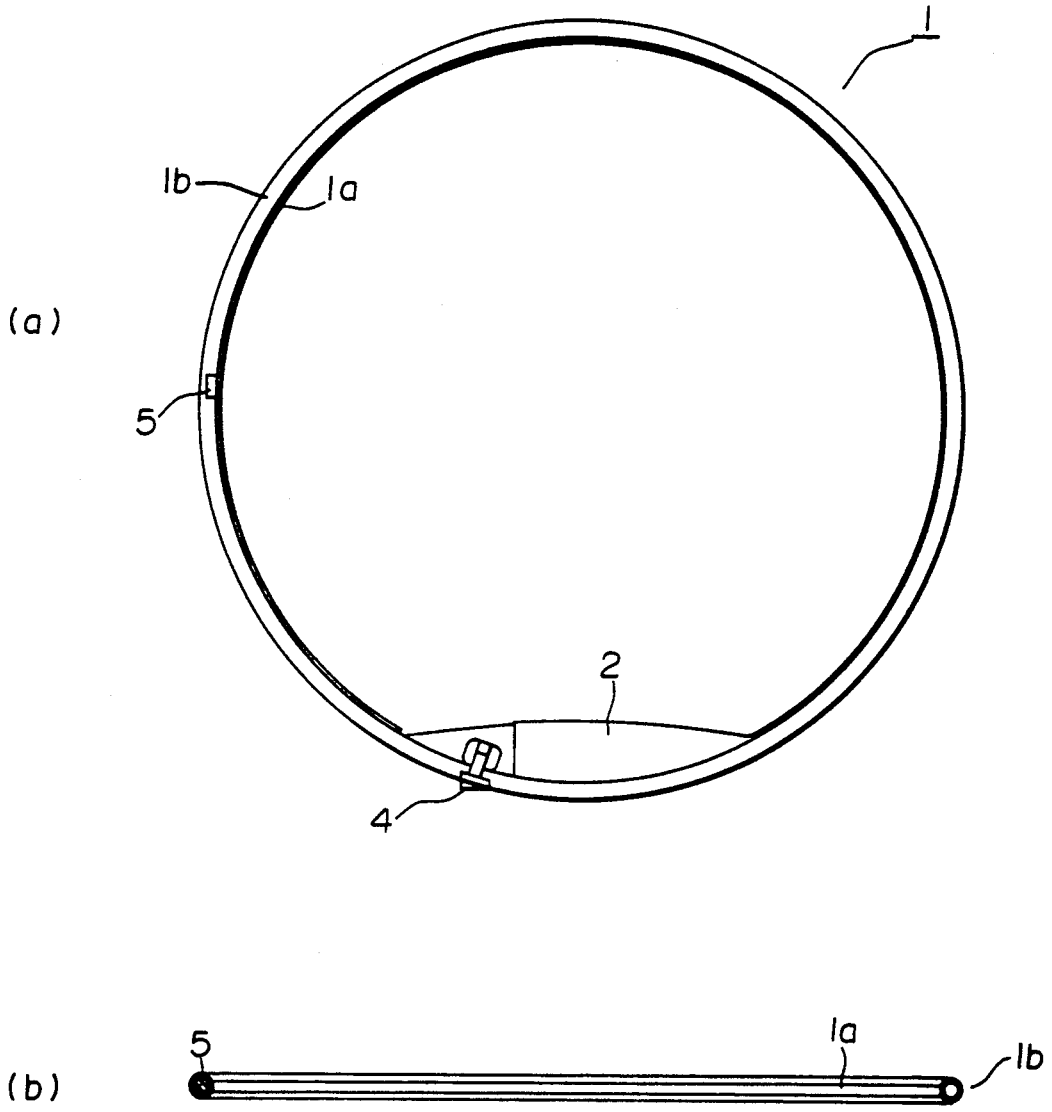
FIG. 1*a* is a view from above the plane of the ring-shaped body.
FIG. 1*b* is a cross sectional view through a diameter of the ring-shaped body.
Figure 2:
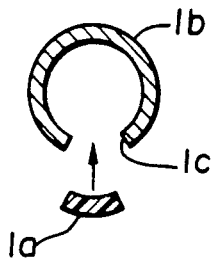
FIG. 2 is an enlarged view of the cross-section in FIG. 1*b;*

FIG. 1*a* is a view perpendicular to the plane of the ring-shaped body, and FIG. 1*b* is a cross-sectional view through a diameter of the ring-shaped body, showing one of many possible embodiments of this design. In the figure, the ring-shaped body 1 has a diameter of approximately 300 mm. The exterior toroidal major section 1*b* is composed of, for example, a rubber material, a plastic material, or a metal, while the interior partial toroidal minor section 1*a* may be preferably composed of a rubber or plastic material. The cross section of the toroid 1 has a major arc 1*b* as shown in FIG. 1*b*, and this cross section is shown enlarged in FIG. 2. The minor arc 1*a*, which is a cross section of the interior partial toroidal minor section, is shown detached in FIG. 2. The above-mentioned interior partial toroidal minor section 1*a* is mounted so as to complete the toroidal shape over most of the circumference and form a tube. In FIG. 1, Grip 2 is mounted on a portion of the inner surface of the body 1 which is not covered by the interior partial toroidal minor section 1*a*, with the purpose of allowing easy grasping and swinging. Said grip 2 is directly mounted on the interior of the outer toroidal major section 1*b*.

Figure 3:
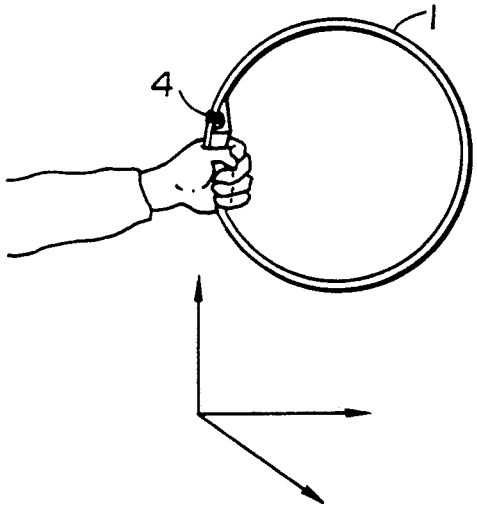
FIG. 3 shows the ring-shaped body being held by a user.

FIG. 3 shows grip 2 being held so that the ring-shaped body 1 may be swung either vertically or horizontally. On the grip 2, switch 4 is used to select the musical tone, and is mounted in a position where it can be operated by the thumb. An acceleration sensor 5 (shown in FIG. 1*b* is mounted at the highest point inside the tube 1 when the grip 2 is held and the ring is held straight to the side of the user. This acceleration sensor 5 is tilted 45 degrees with respect to the plane of the ring as well as with respect to the user, and this allows the one acceleration sensor to detect acceleration in more than one direction. If the acceleration sensor were parallel to only one direction of motion, the acceleration sensor could detect acceleration only in that direction; another acceleration sensor would be required to detect acceleration in any other direction.

The electrical configuration of this embodiment, shown in FIG. 4, will now be described. The musical tone signal generating circuit 9 shown in this figure converts the signal from the acceleration sensor 5 into a musical tone signal. The musical tone generating circuit is comprised of a key-on amplitude detection circuit 10 which generates key-on signals (keyboard signals corresponding to the signals output when a key is depressed) based on the output signal Sa of the acceleration sensor 5. This key-on amplitude detection circuit 10 identifies a key-on state and outputs a key-on signal KON when the value of signal Sa exceeds the standard value. It also outputs a voltage signal (or a current signal), LVL, corresponding to the amplitude of signal Sa. In other words, the key-on amplitude detection circuit 10 has a comparator that compares the standard value with signal Sa and a circuit that detects the peak value of signal Sa. An output signal Sa of the acceleration sensor 5 is supplied to the key-on amplitude detection circuit 10 via a cable or by wireless means. Next, an A/D (analog-digital) converter 11 converts the signal LVL into a digital signal and supplies it to register 12. A register 13 temporarily stores the key-on signal KON, and another register 14 temporarily stores signal SEL, which is the on-signal of switch 4. Signal SEL may be supplied from switch 4 via either a cable or by wireless means. A CPU 15 (central processing unit) controls various parts of the apparatus, and a memory 16 stores programs used in CPU 15 and other various kinds of data. CPU 15 scans the contents of each register 12–14 successively, and when the contents of register 13 and 14 are scanned, these registers are reset. The tone color data for various types of sounds are previously stored in memory 16, and this tone color data may be selected by repeatedly pressing musical tone selection switch 4. A tone generator 17 generates musical tone signals based on the key-on signal KON, signal LVL, and the tone color data that are supplied via CPU 15. Based on these data, a musical tone signal wave form is selected and wave forms of the attack portion and sustained portion of the musical tone signal are controlled.

Operations according to the above-mentioned configuration will now be described. First, musical tone selection switch 4 is depressed an adequate number of times to select the desired tone color. For example, if the tone color of a bass drum is selected as the initial condition, depressing musical tone selection switch 4 once may generate a snare-drum tone color; depressing the same switch 4 twice may generate a wood-block tone color. The tone color changes successively according to the number of times switch 4 is depressed, and after a prescribed number of switchings is performed, the initial bass-drum tone color is selected again.

When the apparatus is used, the ring-shaped body 1 may be swung vertically by grasping the grip 2. Of all the acceleration vectors generated in this vertical movement, those vectors with an angle of 45 degrees to the perpendicular direction are detected by the acceleration sensor 5. The output signal Sa of the acceleration sensor 5 is then supplied to the key-on amplitude detection circuit 10 to generate key-on signal KON and signal LVL. The tone generator 17 then generates a musical tone signal at the same time that signal KON is output, and musical tone signals of different volumes and of varied tone colors are formed according to signal LVL.

When the body 1 is swung horizontally by grasping grip 2, of all the accelerations generated in this horizontal movement, the elements with an angle of 45 degrees to the horizontal direction are detected by the acceleration sensor 5. In the same manner as described above for a vertical movement, musical tone signals are formed.

The acceleration sensor 5 is thus tilted 45 degrees to both the horizontal and perpendicular directions, and therefore the acceleration in both the horizontal and the perpendicular directions can be detected equally with only one acceleration sensor 5. It is also possible to use, instead of the one acceleration sensor 5 as described above, two or more acceleration sensors detecting horizontal acceleration and perpendicular acceleration separately. Also, the angle of tilt is not restricted to 45 degrees as in the case of the embodiment, and any other angle can be used, although the merit of using the angle of 45 degrees is that the horizontal and perpendicular accelerations can be equally detected using one acceleration detector. Moreover, other sensors that can detect the movement of the body 1 can be used.

Figure 5:
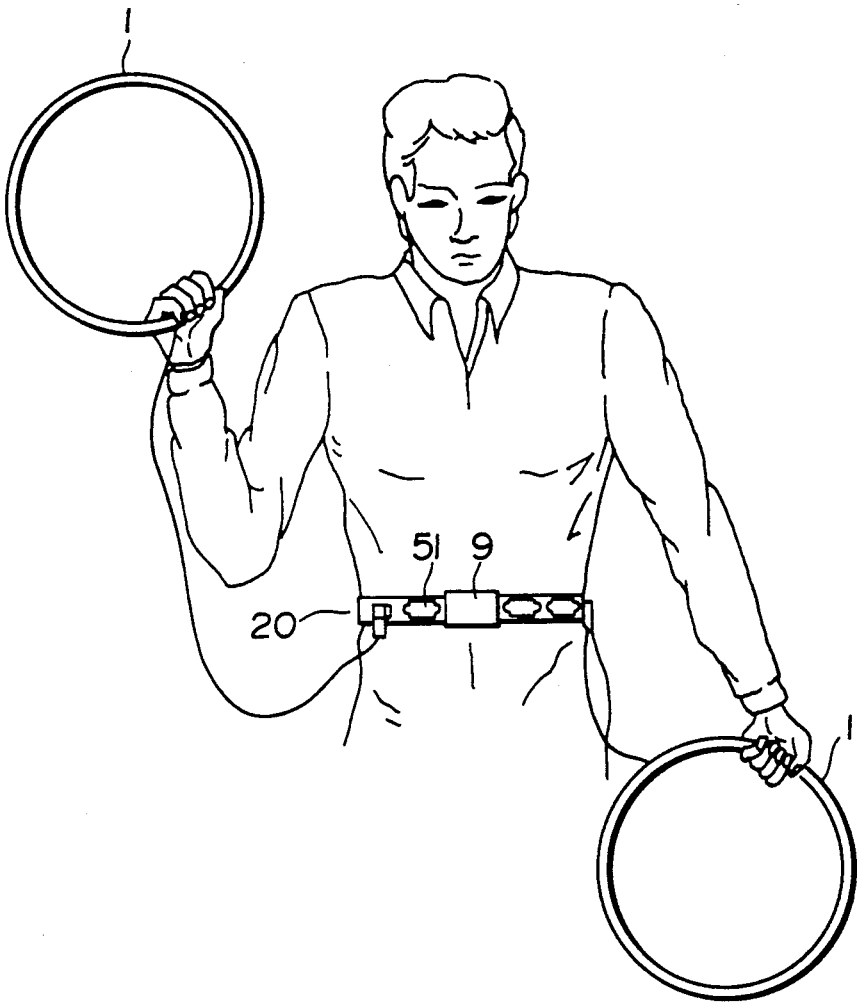
FIG. 5 shows the ring-shaped acceleration sensors, and the belt-shaped casing containing the musical tone signal generating circuit and the batteries, being operated by the user.

As shown in FIG. 5, it facilitates movement and is favorable if the musical tone signal generation circuit 9 and the batteries are held in the belt-shaped casing 20.

Figure 6:
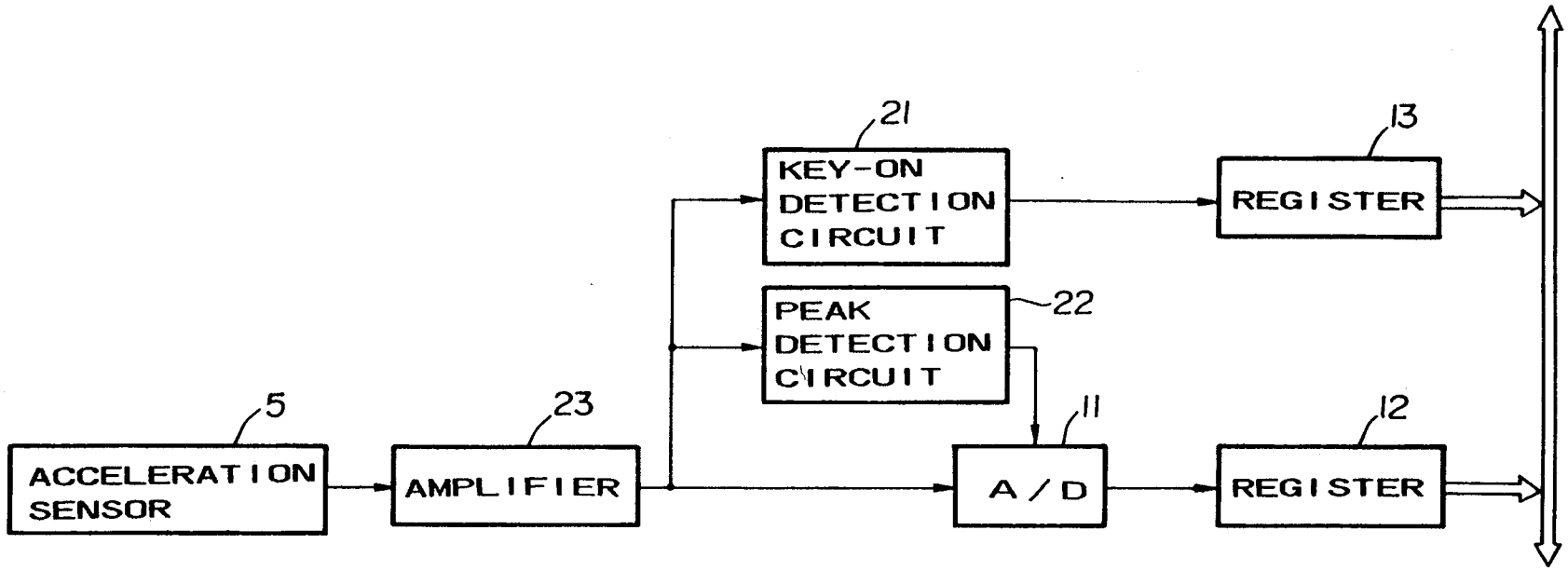
FIG. 6 is a block diagram showing a possible modification of the present invention of the configuration of the musical tone signal generating circuit 9.
Figure 7:
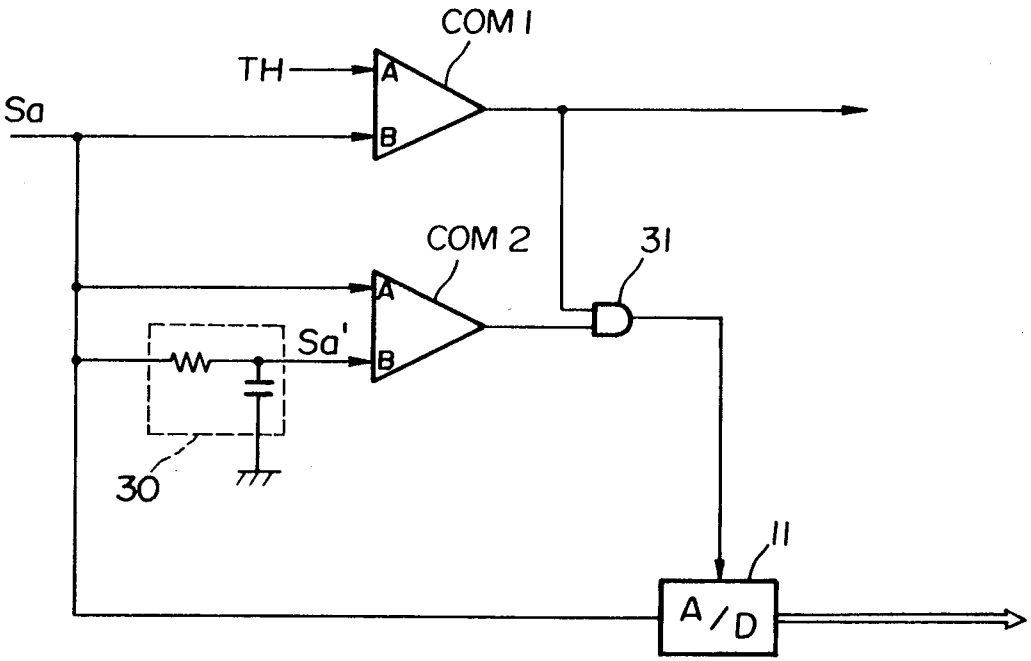
FIG. 7 shows details of the key-on detection circuit and the peak detection in FIG. 6.

The following are some of the possible variations of the above mentioned embodiments. FIG. 6 is a block diagram showing an example of a configuration of the musical tone signal generating circuit 9. In FIG. 6, the output signal Sa of the acceleration sensor 5 is supplied to the key-on detection circuit 21, peak detection circuit 22 and A/D converter 11 after being amplified by the amplifier 23. Details of the key-on detection circuit 21 and peak detection circuit 22 are shown in FIG. 7. In FIG. 7, COM1 is a comparator constituting the key-on detection circuit 21, in which a prescribed threshold level TH is supplied to the inverted input terminal A, and signal Sa is supplied to the non-inverted input terminal B. An integrated circuit 30, and an and-gate 31, together with the comparator COM2, constitute the peak detection circuit 22. Signal Sa is supplied to the inverted input terminal A of the comparator COM2 and at the same time is supplied to the non-inverted input terminal B after being delayed by the integrated circuit 30 to produce signal Sa'. The and-gate 31 makes a logical product of the output signals of comparators COM1 and COM2, and then produces a sampling signal to the A/D converter 11.

Figure 8:
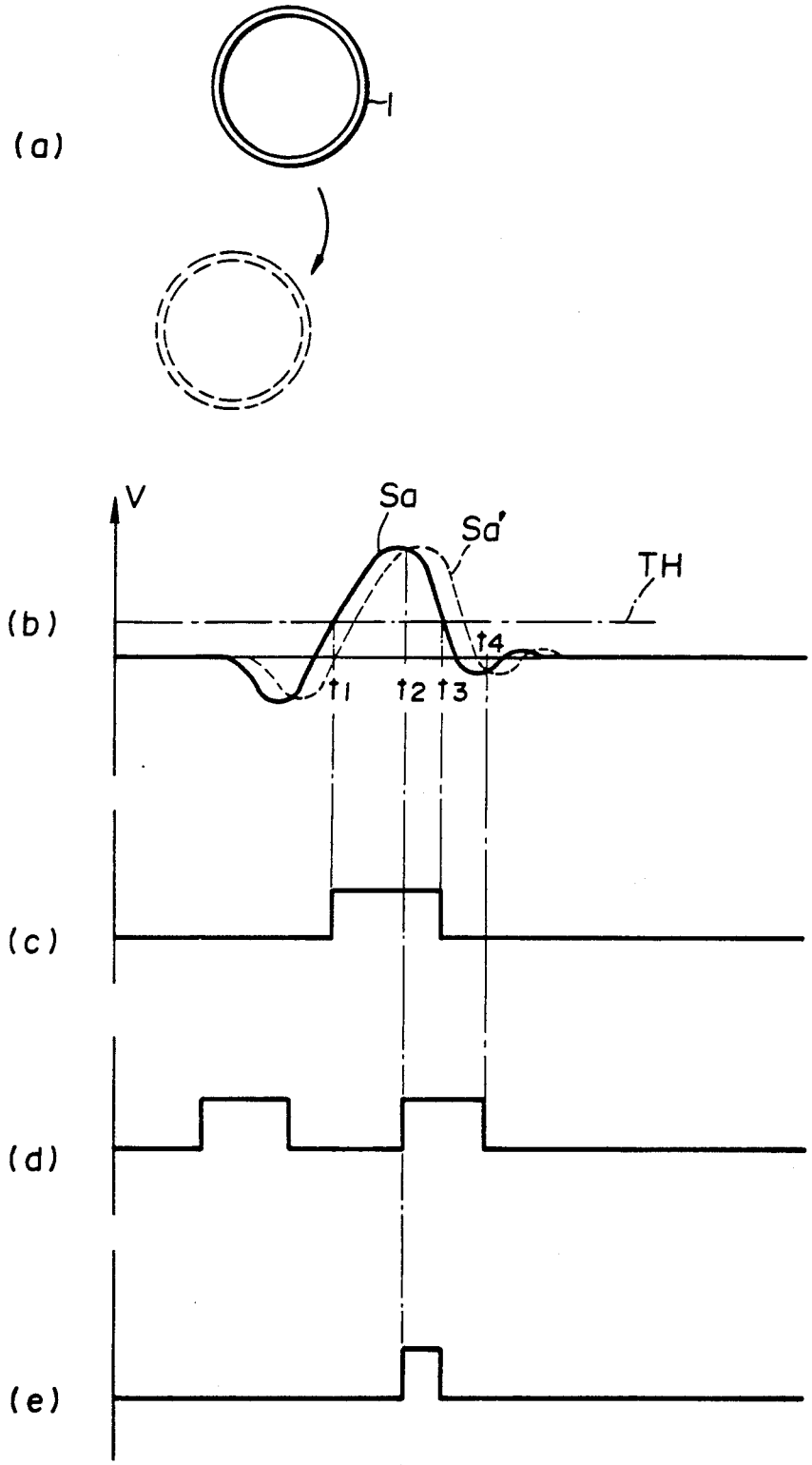
FIG. 8*a* shows the downward motion of the ring-shaped body during operation by a user.
FIGS. 8*b*–8*e* illustrate the electrical wave forms produced by the acceleration sensor and by the musical tone signal generating circuit.

The following is a description of the operation according to the above embodiment. When the body 1 is swung downward as shown in FIG. 8*a*, the output signal Sa of the acceleration sensor 5 changes as shown in FIG. 8*b*. With the threshold level TH at the level shown in FIG. 8*b*, the output signal of the comparator COM1 rises at time t1 when signal Sa passes the threshold level TH. This output signal is supplied to the register 13 as a key-on signal, KON. The output signal of the comparator COM1 remains high until time t3 when signal Sa becomes lower than the threshold level TH. At this time, signal Sa is delayed by the integrating circuit 30 to become signal Sa' as shown by the dotted line in FIG. 8*b*. The output signal of the comparator COM2 increases when Sa' is larger than Sa, and therefore this high level is maintained during the time t2 to t4 as shown in FIG. 8*d*. Here, the output signal of the and-gate 31, which is a logical product of comparator COM1 and comparator COM2, increases at time t2, as shown in FIG. 8*e*. The time t2 is roughly simultaneous with the peak of signal Sa. Here, time t2 depends on the signal time delay of the integrating circuit 30 to enable accurate peak time detection. Sampling is triggered at the A/D converter by the output signal of the and-gate 31 for sampling at the peak level.

The digital processing of the key-on detection circuit and the peak detection circuit of FIG. 9 will be described. In this case, the output signal of the amplifier 20 is converted from analog to digital by the sampling signal SP of a fixed cycle (e.g., 5 ms) using the A/D converter 11, and the converted signal is supplied to the key-on detection circuit 40, peak detection circuit 41 and register 12. The output signal of the peak detection circuit 41 is used as a latch signal for the register 12. The key-on detection circuit 40 performs key-on detection by comparing data supplied from the A/D converter 11 with a prescribed standard value. In the peak detection circuit 41, data from,, the A/D converter 11 after the key-on time is latched. Then by comparing the previous data with the current data, the maximal value is obtained to become the peak value. At the time of peak detection, the latch signal is supplied to the register 12. In this way, the peak value is latched to the register 12.

Figure 9:
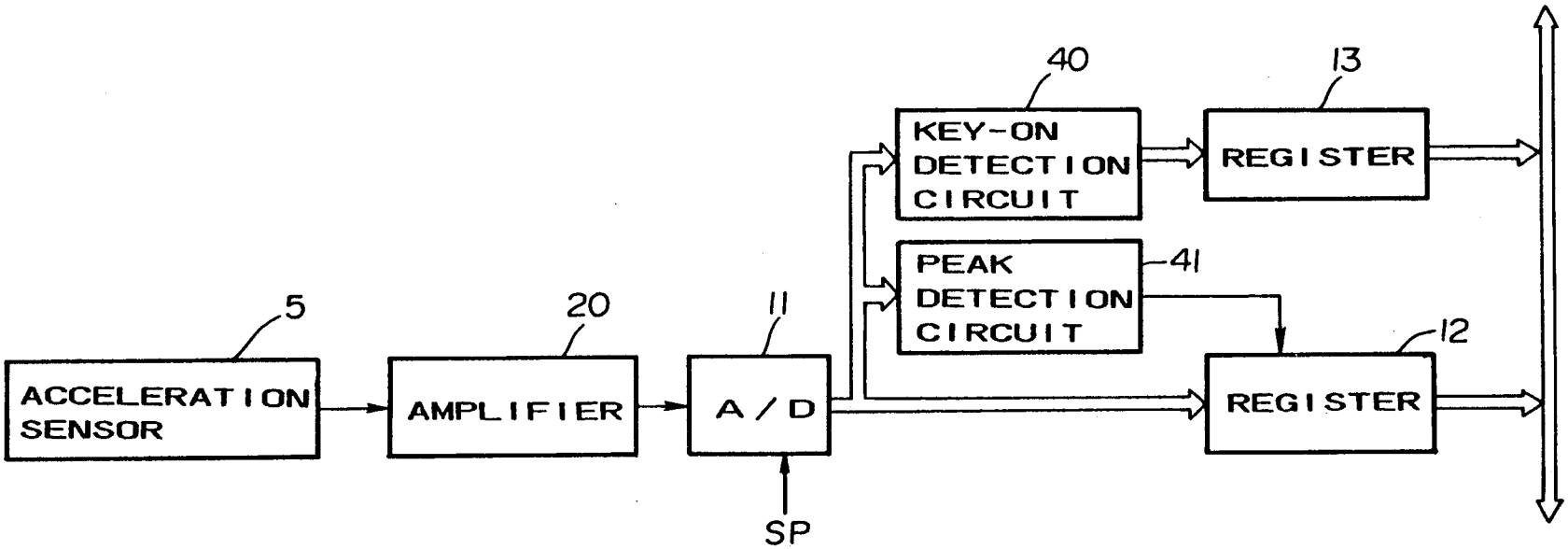
FIG. 9 is a block diagram showing the acceleration sensor and the musical tone signal generating circuit.
Figure 10:
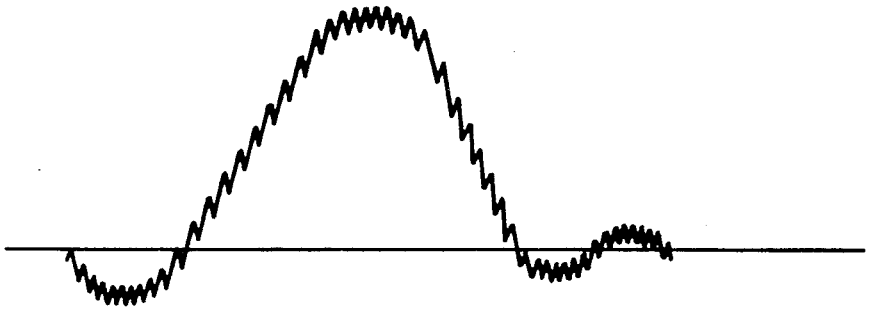
FIG. 10 shows a wave form in which there is considerable noise.

As shown in FIG. 10, when there is considerable noise in the output signal from the acceleration sensor 5 in FIG. 9, the existence of many local maximum values causes the peak detection circuit 41 to malfunction. If, for example, the output data of the A/D converter 11 has 8 bits, the lower 2 bits that are affected by the noise can be ignored and peak detection can be performed with only the upper 6 bits.

As described above, according to the present invention, the apparatus is equipped with a ring-shaped body that can be gripped, a sensor that is mounted, inside the ring-shaped body and that detects that said body when it is swung, and a musical tone generating means that generates musical tone control signals for controlling the musical tone based on the sensor detected signals. Irrespective of the concept of playing, musical tones can be created based on the human action of swinging. Therefore, a totally new playing effect is achieved.

In the case in which it is not desirable to hold the the acceleration sensor in the hand, another embodiment of the present invention allows the the acceleration sensor, contained in a housing, to be attached by a detachable means to a material which is placed around a part of the body, such as the wrist, ankle, or neck.

Figure 11:
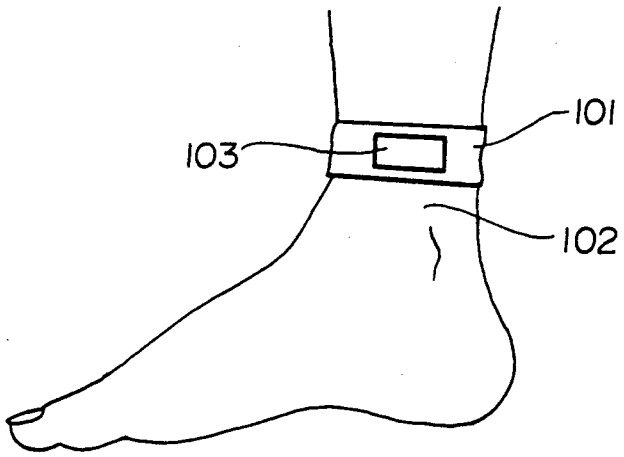
FIG. 11 shows a user wearing the acceleration sensor in a detachable housing around the ankle.

FIG. 11 is a view of the detachable acceleration sensor being worn by a user around the ankle 102. The material is placed around a body part in such a manner as to be firmly held in place. This material 101 may be formed, for example, as a band of material around the ankle or waist, or as a glove for the hand, or as a sock for the foot.

Figure 12:
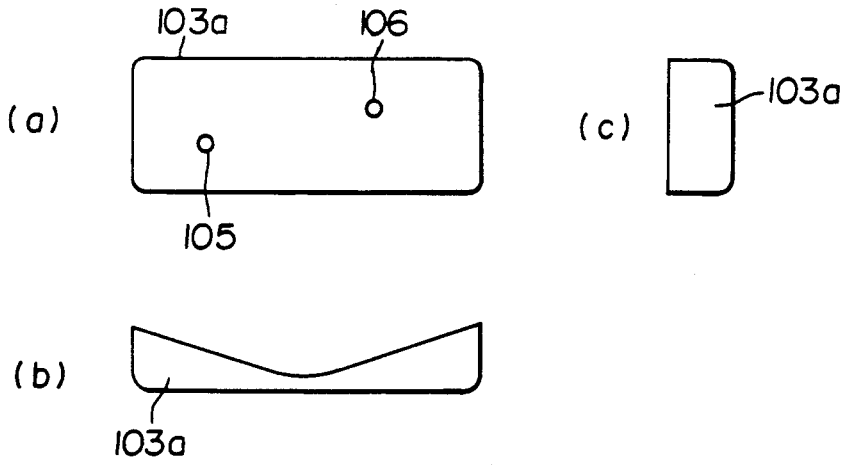
FIG. 12 shows the detachable housing containing the acceleration sensor from the front (FIG. 12*a*), from the top (FIG. 12*b*), and from the side (FIG. 12*c*)

FIG. 12 shows detailed views of the acceleration sensor housing 103, from the front FIG. 12*a*, from the top FIG. 12*b*, and from the side FIG. 12*c*. The top view in FIG. 12*b* shows the manner in which the housing 103 is curved to accommodate the curvature of the part of the body around which it is worn.

Figure 13:
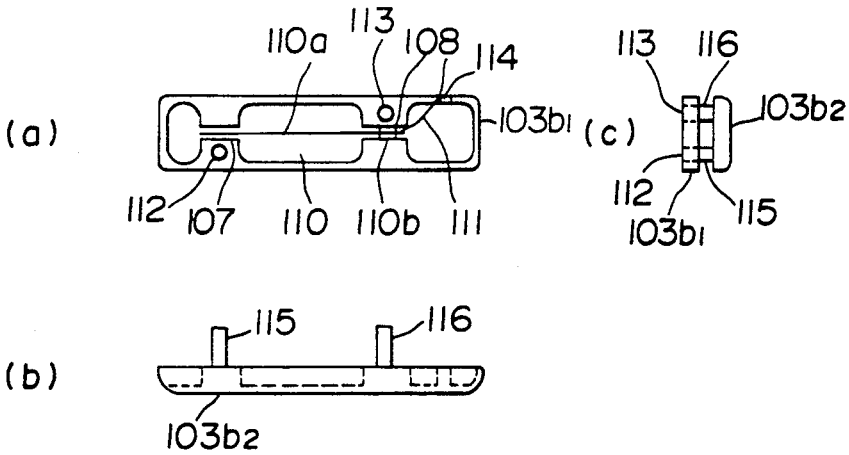
FIG. 13 illustrates the interior structure of the detachable housing in FIGS. 13*a* and 13*b*, and a side view of the assembled housing in FIG. 13*c*.

In FIG. 13, the housing 103 is shown in its major part 103*b*1 in FIG. 13*a*, and in its minor part 103*b*2 in FIG. 13*b*. Part 103*b*1 has an interior depression 110 which has narrow areas 107 and 108, and through holes 112 and 113, and an exit hole 114 for the sensor wire to pass out of the housing 103. A narrow rod 110*a* is placed so as to pass from narrow area 107 to narrow area 108. When weight 110*b* slides along rod 110*a* in response to an acceleration force, an acceleration signal is generated to be transmitted via cable 111. Part 103*b*2 has prongs 115 and 116 to be inserted into through holes 112 and 113, respectively. When the parts 103*b*1 and 103*b*2 are assembled as shown in the side view in FIG. 13*c*, a chamber 110 is formed with two narrow passages to form the housing of the acceleration sensor.

Figure 4:
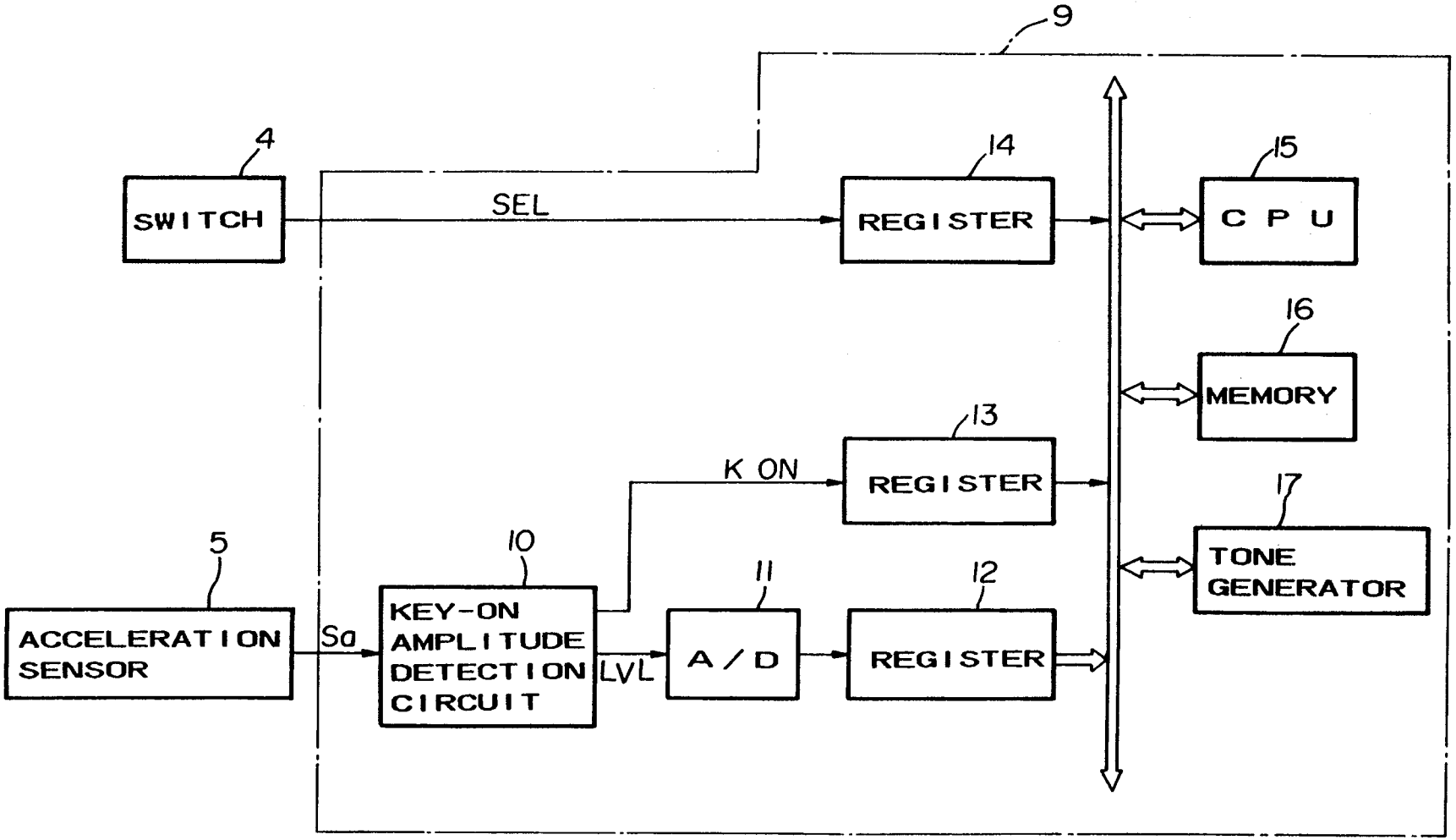
FIG. 4 is a block diagram of an embodiment of the musical tone signal generating circuit.
Figure 14:
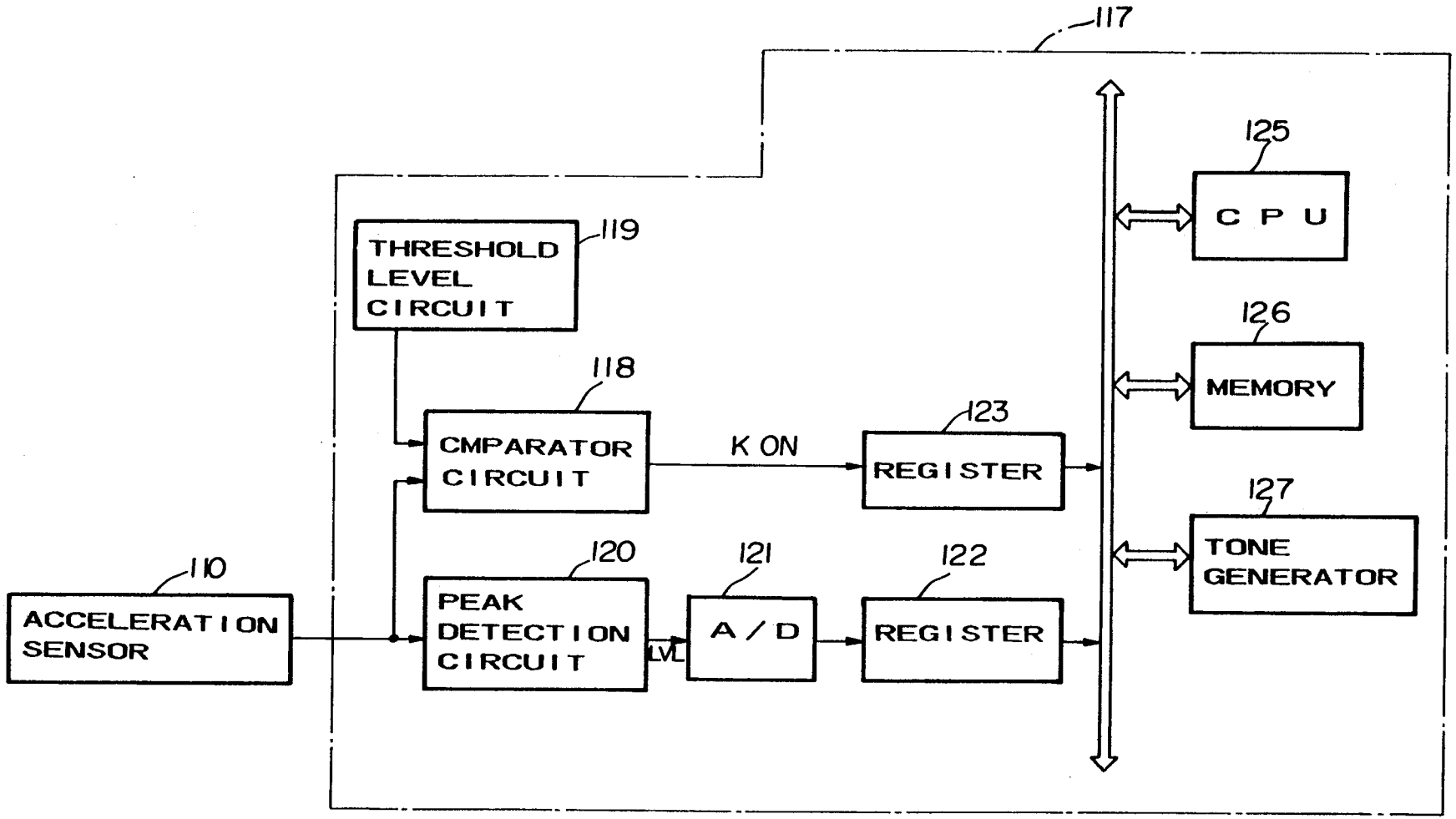
FIG. 14 is a block diagram of an embodiment of the musical tone signal generating circuit.

It is possible for the musical tone signal generating circuit 9 shown in FIG. 4 to be modified for either the embodiment in which the acceleration sensor is contained in a ring-shaped body, or for the embodiment in which the acceleration sensor is contained in a detachable housing. FIG. 14 shows a possible embodiment of the musical tone signal generating circuit 117. In this design, the acceleration sensor 110 transmits a signal to the peak detector 120 and to the comparator circuit 118. The comparator circuit 118 also receives a signal from the threshold level circuit 119. The comparator circuit 118 generates a key-on signal KON when the output signal from the acceleration sensor 110 exceeds the threshold level output from the threshold level circuit 119. The peak value detection circuit 120 outputs a voltage signal LVL that corresponds to the detected value of the acceleration sensor 110. The peak detection circuit 120 is reset immediately after a peak detection in order to receive the next peak detection. The A/D (analog-digital) 121 converter converts the signal LVL into a digital signal and supplies it to register 122. Register 123 temporarily stores signal KON. The CPU (central processing unit) 125 controls various parts of the apparatus, and memory 126 is a memory that stores programs used by CPU 125 and various other kinds of data. CPU 125 scans the registers 123 and 122 successively, uses the data from the memory 126, then outputs the appropriate signal to the tone generator 127, which generates the musical tone signal.

Figure 15:
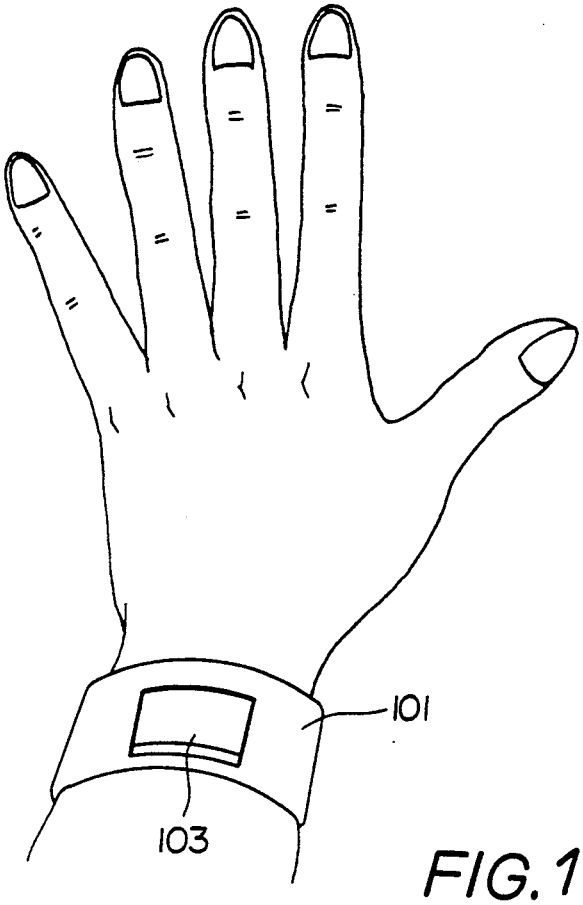
FIG. 15 shows the acceleration sensor in the detachable housing being worn by a user around the wrist.
Figure 16:
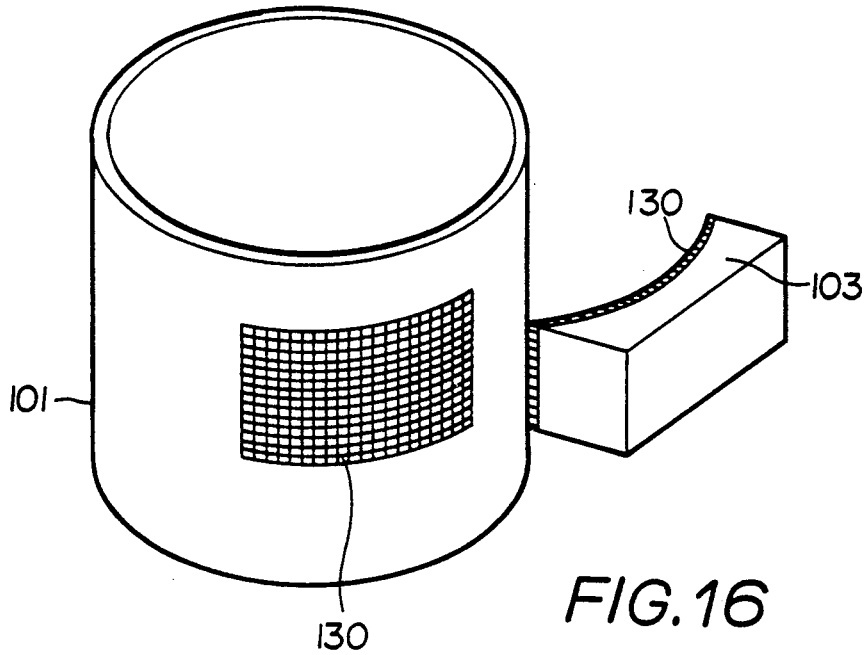
FIG. 16 shows an enlarged view of the detachable acceleration sensor housing and the means by which it is placed around a part of the body.

FIG. 11 shows the embodiment of the acceleration sensor contained in a detachable housing being worn by a user around the ankle. However, this embodiment of the acceleration sensor could be worn around the wrist as well, as shown in FIG. 15. In this example, the material 101 around the part of the body is in the shape of a band, upon which is affixed one half of a "Velcro" (Trademark) type fastener 130 (referred to as a fastener hereinafter); the complementary half of the "Velcro" (Trademark) type fastener 130 (referred to as a fastener) is affixed to the acceleration sensor housing 103, as shown in FIG. 16. This allows the user to control the musical tone signal by the movement of the arms without having to hold the acceleration sensor in the hand.

Figure 17:
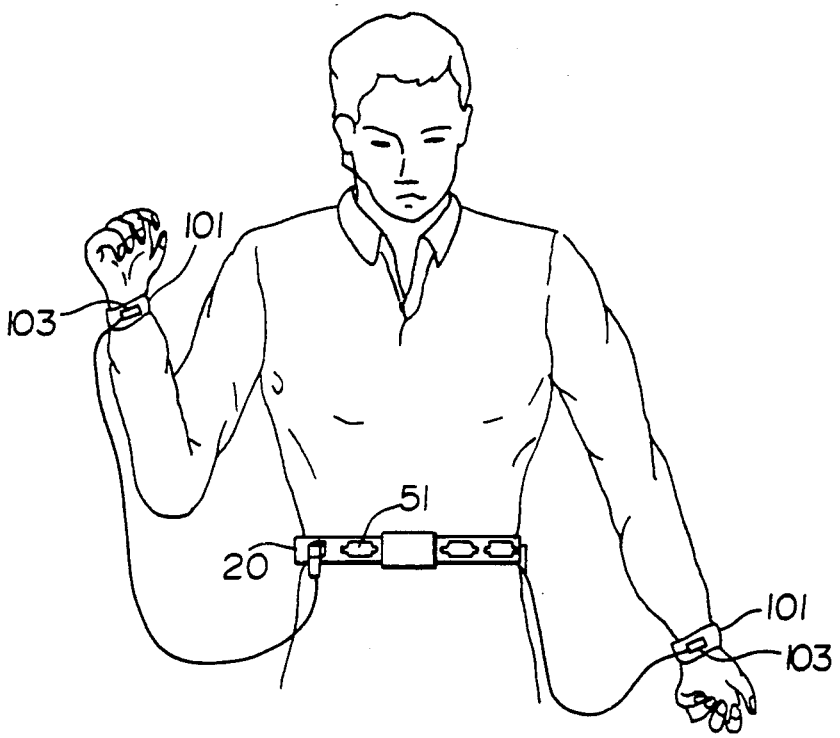
FIG. 17 shows the detachable acceleration sensors being worn by a user around the wrists, and the belt-shaped casing containing the musical tone signal generating circuit and the batteries.

In FIG. 17, an arrangement of the apparatus being operated by a user is shown, which is similar to that shown for the use of ring-shaped bodies in FIG. 5. In this FIG. 17, the user is shown wearing a belt-shaped casing which holds the batteries 51 and the musical tone signal generating circuit 9 or the musical tone signal generating circuit 117. In this example, the acceleration sensors in the acceleration sensor housings 103, which are held in place by a "Velcro" (Trademark) type attachment to a material around the wrist, are connected to the belt-shaped casing by cables to conduct the signal from the acceleration sensors. This arrangement allows the user to move freely.

In the operation of this embodiment, when a user moves the part of the body monitored by the acceleration sensor, a signal is sent to the musical tone signal generating circuit, which then produces a musical tone signal to be output to speakers.

What is claimed is:

1. A musical tone control apparatus comprising:

(a) a motion sensor for detecting motion of the motion sensor itself, wherein the motion sensor has a band shape and is adapted to be attached to a human body and comprises an acceleration sensor generating and outputting a measurement signal responsive to the acceleration of the motion sensor, and (b) a musical tone control signal generating means for receiving the measurement signal to thereby detect peaks of the measurement signal, so that a musical tone parameter is controlled based on detected peaks of the measurement signal; whereby a musical tone control signal is generated in response to the detected peaks and in response to acceleration of the motion sensor attachable to the human body to thereby control a manual musical performance.

2. A musical tone control apparatus according to claim 1 wherein the motion sensor comprises a holder means for supporting the motion sensor on a human body and a housing containing the motion sensor to be detachably attached to the holder means by means of a fastener.

3. A musical tone control apparatus according to claim 1 wherein the musical tone control signal generating means comprises a holder in a belt-shaped casing adapted to be worn around the waist of the body.

4. A musical tone control apparatus according to claim 1 wherein the musical tone control signal generating means comprises a detection means for detecting when the measurement signal exceeds a predetermined threshold value, and for outputting a key-on signal when the predetermined threshold is surpassed, whereby the key-on signal is generated in response to an acceleration exceeding the predetermined threshold value.

5. A musical tone control apparatus according to claim 4 wherein the musical tone control signal generating means further comprises an A/D converter for converting an analog measurement signal to a digital measurement signal, a memory means for storing the predetermined threshold value, and a comparator for comparing the digital measurement signal with the threshold value.

6. A musical tone control apparatus according to claim 1 wherein the musical tone control signal generating means comprises a peak detection means for detecting peaks of the measurement signal and outputting a peak signal when the peaks are detected, whereby the musical tone control signal is generated in response to the peak signal.

7. A musical tone control apparatus according to claim 1, wherein the motion sensor is in the form of a wrist band.

8. A musical tone control apparatus according to claim 1, wherein the motion sensor is in the form of an ankle band.

9. A musical tone control apparatus as set out in claim 1, wherein the motion sensor detects motion of the part of the human body to which the motion sensor is attached.

10. A musical tone control apparatus comprising:

(a) a motion sensor for detecting motion of the motion sensor itself and outputting a measurement signal responsive to the motion, the motion sensor being adapted to be held by hand and comprising a ring-shaped body;

a selection switch attached to the ring-shaped body for outputting a selection signal responsive to the operation of the selection switch;

an acceleration sensor attached to the ring-shaped body; and (b) a musical tone control signal generating means for receiving the measurement signal and generating a musical tone control signal in response thereto; whereby the musical tone control signal is generated in response to the motion of the motion sensor held by hand.

11. A musical tone control apparatus according to claim 10 wherein:

a main portion of the ring-shaped body comprises an exterior toroidal major section having a groove therealong and an interior partial toroidal minor section attached to the major section so as to form a tube by the union thereof having a passage therealong;

the ring-shaped body includes a hand grip which subtends a gap in the minor section; and the acceleration sensor is placed at an angle such that it is neither parallel nor perpendicular to a plane defined by the ring-shaped body.

12. A musical tone control apparatus according to claim 10 wherein the ring-shaped body has a toroidal cross-section.

13. A musical tone control apparatus according to claim 10 wherein the ring-shaped body has a hand grip attached thereto.

14. A musical tone control apparatus comprising:

(a) a motion sensor for detecting motion of the motion sensor itself, wherein the motion sensor is adapted to be attached to a human body and comprises an acceleration sensor generating and outputting a measurement signal responsive to the acceleration of the motion sensor, the motion sensor also comprising holder means for supporting the motion sensor on a human body, a housing containing the acceleration sensor, and fastener means for detachably fastening the housing to the holder means, and (b) musical tone control signal generating means for receiving the measurement signal and generating a musical tone control signal in response thereto; whereby the musical tone control signal is generated in response to acceleration of the motion sensor attachable to the human body to thereby control a manual musical performance.

* * * * *